United States Patent [19]

Kuus et al.

[11] 4,117,369

[45] Sep. 26, 1978

[54] HIGH-PRESSURE DISCHARGE LAMP

[75] Inventors: Gijsbert Kuus; Adriaan Jan de Ridder, both of Eindhoven, Netherlands

[73] Assignee: U.S. Philips Corporation, New York, N.Y.

[21] Appl. No.: 834,955

[22] Filed: Sep. 20, 1977

[30] Foreign Application Priority Data

Oct. 8, 1976 [NL] Netherlands ..... 7611136

[51] Int. Cl.[2] ..... H01J 19/68

[52] U.S. Cl. ..... 313/178; 313/174

[58] Field of Search ..... 313/174, 176, 178

[56] References Cited

FOREIGN PATENT DOCUMENTS 2,452,044 Fed. Rep. of Germany.

*Primary Examiner*—Rudolph V. Rolinec
*Assistant Examiner*—Darwin R. Hostetter
*Attorney, Agent, or Firm*—Frank R. Trifari; Robert S. Smith

[57] ABSTRACT

A high-pressure discharge lamp having a hydrogen getter in a metal envelope of which only a part consists of a hydrogen-permeable metal. The getter is arranged in the lamp in such manner that the hydrogen-permeable part of the envelope faces the discharge.

1 Claim, 2 Drawing Figures

HIGH-PRESSURE DISCHARGE LAMP

The invention relates to a high-pressure discharge lamp having a discharge vessel comprising electrodes between which the discharge takes place during operation, a gas filling and a hydrogen getter in a metal, hydrogen-permeable envelope.

Such lamps are known from German Offenlegungsschrift No. 2,452,044.

In the known lamps the hydrogen getter is enclosed in an envelope of hydrogen-permeable metal in order to protect the getter from attack by the gas filling.

It has been found that in lamps which have a long life and the gas filling of which contains metal halides, blackening of the discharge vessel may occur. This is the case notably in halide lamps of lower (400 W or less) power. The blackening proves to consist of the hydrogen-permeable metal of the envelope of the getter which in the long run apparently cannot withstand the conditions prevailing in the lamp during operation.

It has furthermore been found that the metal of the envelope is also transported from places where the envelope has a comparatively low temperature to places where the envelope has a comparatively high temperature. This in spite of the fact that the temperature drop across the surface of the envelope, in view of the small dimensions, is small. The signalled phenomena might result in leakage of the envelope and hence in attack of the getter.

It is an object of the invention to provide means to mitigate blackening of the discharge vessel and metal transport along the surface of the envelope of the getter.

In high-pressure discharge lamps of the kind mentioned in the preamble this object is achieved according to the invention in that only part of the metal envelope of the hydrogen getter which faces the discharge consists of hydrogen-permeable metal.

By means of the construction according to the invention it is achieved both that the hydrogen-permeable envelope part has a uniform temperature, and that said part is at a comparatively high temperature, as a result of which at the surface of the envelope the location of the equilibrium $Me + nHal \rightleftarrows MeHal_n$, wherein Me is the hydrogen-permeable metal, is shifted to the left.

As a hydrogen-permeable metal may be used, for example, tantalum, niobium, vanadium, nickel, iron alloys of at least two of these metals and alloys of at least 5 atm.% of at least one of the said materials with tungsten or molybdenum. In spite of the reduced area of the envelope which is hydrogen-permeable, the gettering function proves to be maintained when said materials are used.

Hydrogen-gettering materials which may be used are inter alia scandium, yttrium, lanthanum, lanthanides and alloys thereof.

As metals which can withstand the conditions prevailing in the lamp and from which the remaining part of the envelope of the hydrogen getter may be manufactured, may be mentioned, tungsten, molybdenum and alloys thereof.

It may be recommendable, for example, when using nickel or iron, to keep the getter separated from the envelope. This may be effected by means of a spacer ring or a perforated or porous layer or foil or an inert material, for example, tungsten, molybdenum, a nitride, oxide or carbide of a lanthanide, of yttrium, scandium, aluminium, zirconium or hafnium.

If and in so far as the envelope of the getter is manufactured from a foil, it may be approximately 5 to 500 μm thick. When the envelope has been deposited on the getter from a vapour phase, the thickness as a rule is between 0.1 and 100 μm.

The getter is preferably positioned in a lamp, for example a high-pressure mercury lamp with metal halide addition or a high-pressure sodium lamp, in such manner that the getter reaches a temperature of approximately 900° C during operation.

The invention also relates to a hydrogen getter in a metal, hydrogen-permeable envelope suitable for use in a high-pressure discharge lamp which is characterized in that only a part of the metal envelope of the getter consists of hydrogen-permeable metal.

An embodiment of a lamp according to the invention is shown in the Figures.

Figure 1:
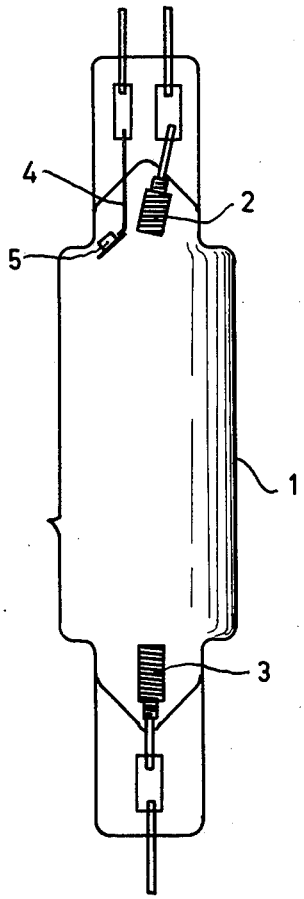
FIG. 1 shows a high-pressure mercury vapour discharge lamp with metal halide addition.

The lamp vessel of a discharge lamp which during operation assumes a power of 400 Watts is denoted by reference numeral 1 in FIG. 1. The discharge vessel has a diameter of 15 mm. Between the electrodes 2 and 3 a discharge can be maintained which is obtained by means of the auxiliary electrode 4. An enveloped hydrogen getter 5 is welded to the electrode 4. The electrodes 2 and 3 are spaced by a distance of 41 mm.

Figure 2:
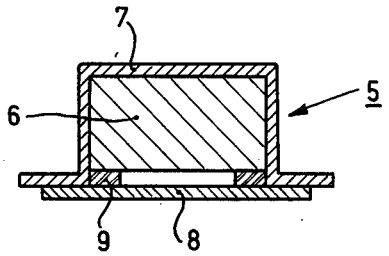
FIG. 2 is a sectional view on an enlarged scale through the enveloped getter of FIG. 1.

In FIG. 2, reference numeral 6 denotes a cylindrical getter of yttrium. The cylinder diameter is approximately 1.6 mm, the cylinder height is approximately 1 mm. The getter has a weight of approximately 10 mg. The bottom part of the envelope of the getter is 100 μm thick and consists of tungsten. The cover part 8 has the same thickness and consists of nickel. A molybdenum spacer ring is denoted by 9. Bottom part and cover part are connected in a gas-tight manner by resistance welding. The lamp was operated at design voltage. The discharge vessel was still bright after a few thousand hours operation of the lamp.

What is claimed is

1. A high-pressure discharge lamp having a discharge vessel comprising electrodes between which the discharge takes place during operation, a gas filling and a hydrogen getter in a metal, hydrogen-permeable envelope, characterized in that only that part of the metal envelope of the hydrogen getter which faces the discharge consists of hydrogen-permeable metal.

* * * * *